US008573914B1

(12) United States Patent
Strange

(10) Patent No.: US 8,573,914 B1
(45) Date of Patent: Nov. 5, 2013

(54) AUTOMATED TRASH TRUCK HAVING A FRONT LOADING CONVEYOR AND METHOD OF USE

(76) Inventor: Robert W. Strange, Temecula, CA (US)

( * ) Notice: Subject to any disclaimer, the term of this patent is extended or adjusted under 35 U.S.C. 154(b) by 826 days.

(21) Appl. No.: 12/603,096

(22) Filed: Oct. 21, 2009

(51) Int. Cl.
*B65F 3/02* (2006.01)

(52) U.S. Cl.
USPC ..... 414/408

(58) Field of Classification Search
USPC ..... 414/738, 565, 408, 406, 501, 502
See application file for complete search history.

(56) References Cited

U.S. PATENT DOCUMENTS

| | | | | | |
|---|---|---|---|---|---|
| 3,011,273 | A | | 12/1961 | Stumpf | |
| 3,547,287 | A | * | 12/1970 | Cunningham, Sr. | 414/565 |
| 3,587,814 | A | | 6/1971 | Garabedian | |
| 3,597,927 | A | | 8/1971 | Hemphill | |
| 3,730,367 | A | * | 5/1973 | Heffington | 414/501 |
| 3,734,318 | A | | 5/1973 | Kraus | |
| 3,762,586 | A | * | 10/1973 | Updike, Jr. | 414/408 |
| 3,841,508 | A | * | 10/1974 | Ebeling et al. | 414/406 |
| 3,889,829 | A | * | 6/1975 | Dutton | 414/732 |
| 3,927,780 | A | | 12/1975 | Dearlove | |
| 4,051,961 | A | | 10/1977 | Williams | |
| 5,253,971 | A | | 10/1993 | Weinlader | |
| 5,333,984 | A | | 8/1994 | Bayne | |
| 5,342,164 | A | | 8/1994 | Kinney | |
| 5,413,448 | A | | 5/1995 | Peshkin | |
| 5,577,877 | A | * | 11/1996 | Smith et al. | 414/408 |
| 5,596,784 | A | | 1/1997 | Tolmanchoff | |
| 5,639,201 | A | | 6/1997 | Curotto | |
| 5,833,429 | A | * | 11/1998 | McNeilus et al. | 414/408 |
| 6,846,148 | B2 | * | 1/2005 | Riba Romeva et al. | 414/408 |
| 7,210,890 | B2 | | 5/2007 | Curotto | |
| 7,553,121 | B2 | | 6/2009 | Curotto | |
| 7,871,233 | B2 | * | 1/2011 | Arrez et al. | 414/408 |
| 8,092,141 | B2 | * | 1/2012 | Curotto et al. | 414/408 |

* cited by examiner

*Primary Examiner* — Joshua Rudawitz
(74) *Attorney, Agent, or Firm* — Timothy Thut Tyson; Ted Masters; Leon D. Rosen & Associates, P.C.

(57) ABSTRACT

A truck for collecting trash from a trash container includes a body having a front, a main hopper, and a trash-receiving station disposed in front of the main hopper. A pick up arm assembly is connected to the front, so that the pick up arm assembly can selectively pick up the trash container and dump the trash into the trash-receiving station. A main conveyor moves the trash from the trash-receiving station to the main hopper. The pick up arm assembly can be easily removed from the front of the truck, and can be pivoted outward for maintenance purposes.

2 Claims, 8 Drawing Sheets

Fig. 1
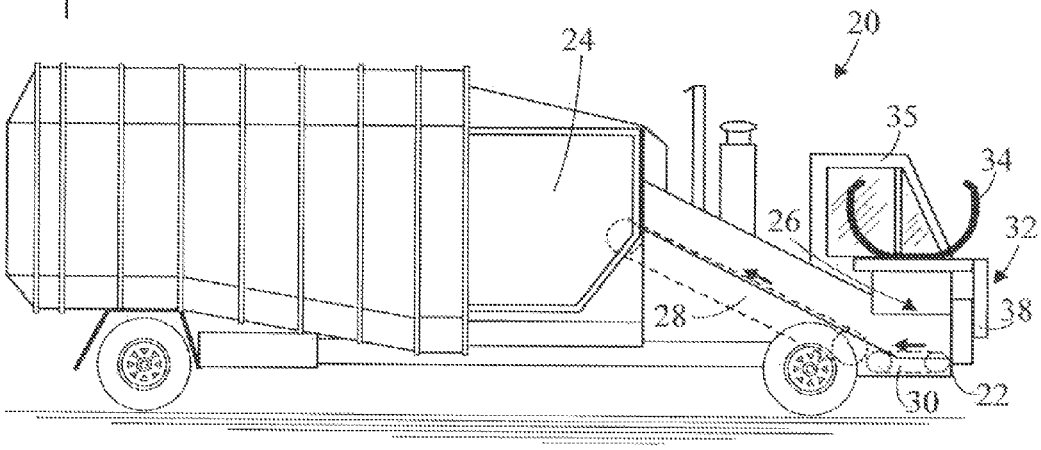
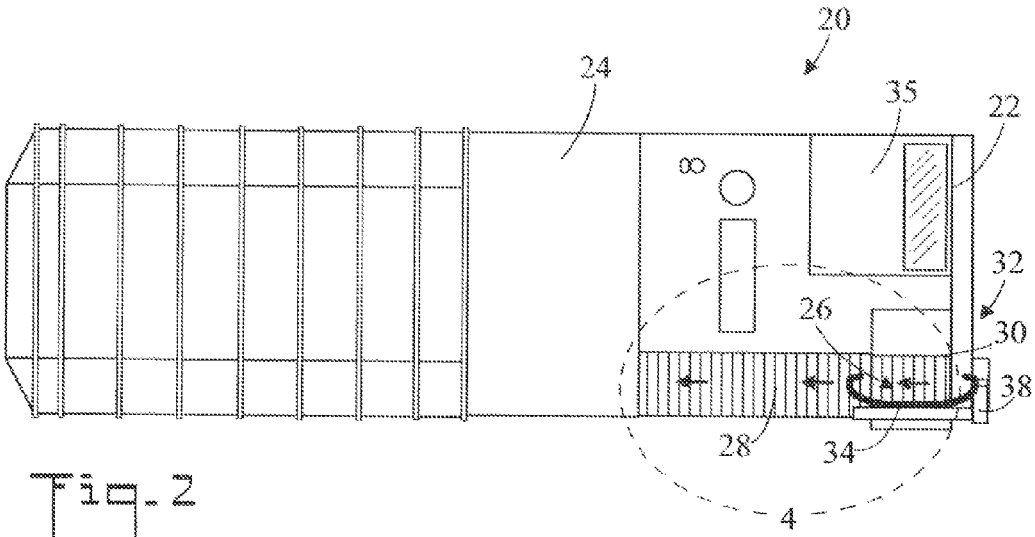
Fig. 2

Fig. 9
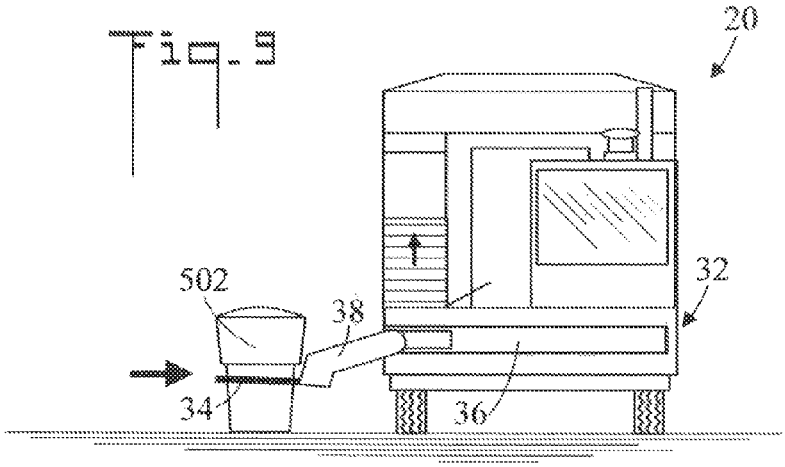
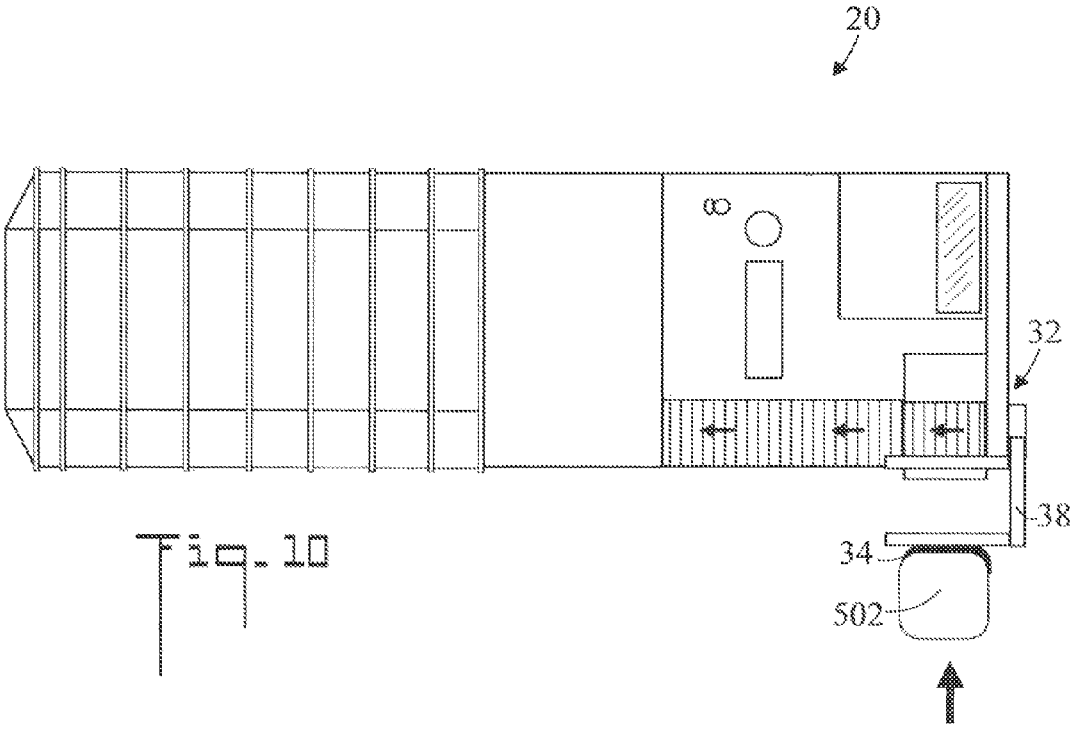
Fig. 10

Fig. 13
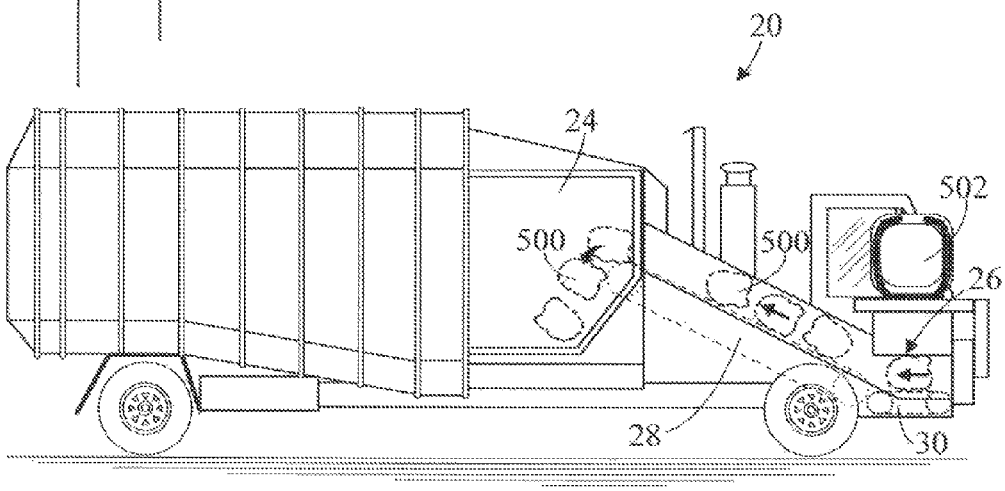
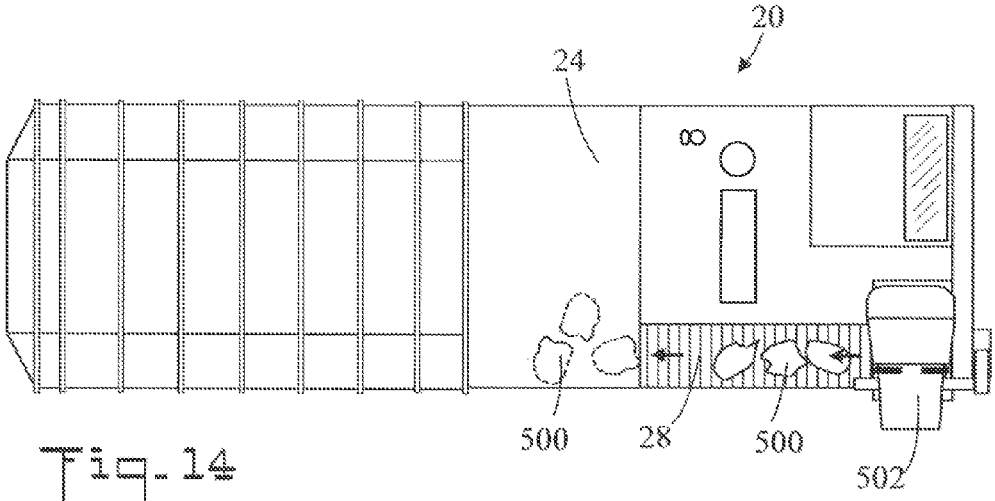
Fig. 14

AUTOMATED TRASH TRUCK HAVING A FRONT LOADING CONVEYOR AND METHOD OF USE

TECHNICAL FIELD

The present invention pertains generally to trash collection, and more particularly to a trash collection truck that has a front mounted pick up arm assembly and conveyor.

BACKGROUND OF THE INVENTION

Trash collection trucks are well known in the art. One such truck is described in U.S. Pat. No. 7,553,121 which shows a truck having an intermediate trash collection container at the front of the truck. The intermediate trash collection container has an integral pick up arm assembly which extends outwardly to grasp a trash container. The pick up arm assembly then retracts and rotates to dump the contents of the trash container into the intermediate trash collection container. When the intermediate trash collection container is full, it along with the integral pick up arm assembly is rotated upward and backward to dump its contents into the main trash collection hopper.

BRIEF SUMMARY OF THE INVENTION

The present invention is directed to a truck for collecting trash from a curbside trash container. The truck has a side loading pick up arm assembly that grasps the trash container and then dumps its contents into a trash-receiving station. A conveyor moves the trash from the trash-receiving station to the main trash collecting hopper of the truck. There is no need to periodically dump the contents of an intermediate trash collection container into the main hopper. The trash is continuously moved into the main hopper by the conveyor. The trash loading cycle time is thereby reduced permitting more trash pickups per hour.

The pick up arm assembly is mounted on the front of the truck. This mounting allows the sliding arm of the assembly to be made as long as the truck is wide thereby increasing the reach of the pick up arm in comparison to arms mounted on intermediate trash collection containers. This mounting also allows the pick up arm assembly to be pivoted away from the front of the truck on a side pin to obtain access to rear components for maintenance. If more than simple maintenance is required, the entire pick up arm assembly can be easily removed by pulling a side pin on each side and replacing the entire pick up arm assembly with another. The relatively expensive truck is then returned to service quickly while the high maintenance pick up arm assembly is repaired off the truck. A half-cab design positions the operator adjacent the arm and trash-receiving station giving him direct visual access to the trash entering the system which he can interrupt if necessary to remove toxic or otherwise unwanted articles.

In accordance with a preferred embodiment of the invention, a truck for collecting trash from a trash container includes a body having a front, a main hopper, and a trash-receiving station disposed in front of the main hopper. A pick up arm assembly is connected to the front of the truck, so that the pick up arm assembly can selectively pick up the trash container and dump the trash into the trash-receiving station.

In accordance with an aspect of the invention, the trash-receiving station is disposed in fixed relationship with the main hopper, and a main conveyor moves the trash from the trash-receiving station to the main hopper.

In accordance with another aspect of the invention, the trash-receiving station includes a secondary conveyor which moves trash toward the main conveyor.

In accordance with another aspect of the invention, the pick up arm assembly is pivotally connected to the front of the truck, so that the pick up arm assembly can be horizontally pivoted outward for maintenance purposes.

In accordance with another aspect of the invention, the pivotal connection is effected by a pinned connector.

In accordance with another aspect of the invention, a pivotal connection having a pinned connector is provided on each side of the pick up arm assembly allowing the pick up arm assembly to be removed and replaced by removing and replacing two pinned connectors.

In accordance with another aspect of the invention, the pick up arm assembly substantially extends across the entire front width of the truck.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 1 is a side elevation view of a truck for collecting trash from a trash container in accordance with the present invention;

FIG. 2 is a top plan view of the truck;

FIG. 9 is a front elevation view of the pick up arm assembly retracted and the trash container drawn toward the truck;

FIG. 10 is a top plan view of FIG. 9;

FIG. 13 is a side elevation view of the main conveyor moving the trash from the trash-receiving station to a main hopper;

FIG. 14 is a top plan view of FIG. 13;

DETAILED DESCRIPTION OF THE INVENTION

Figure 3:
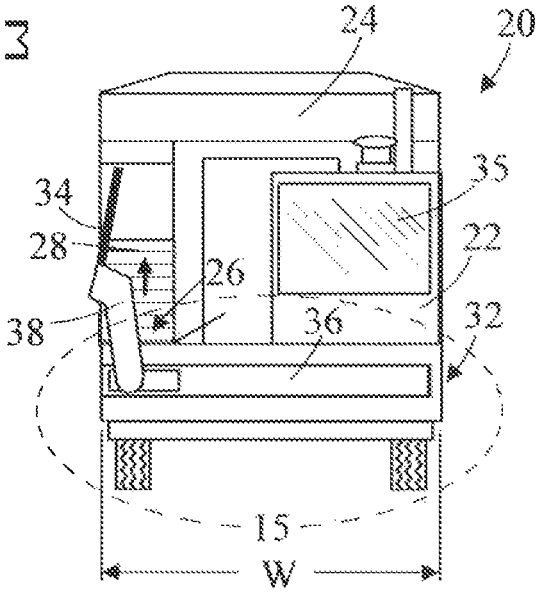
FIG. 3 is a front elevation view of the truck.
Figure 4:
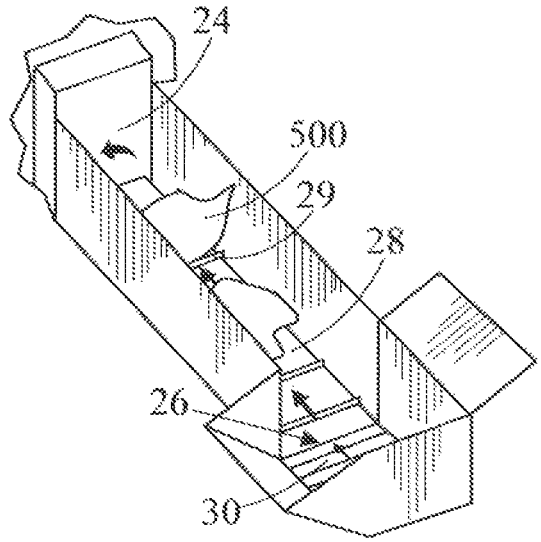
FIG. 4 is an enlarged fragmented perspective view of area 4 of FIG. 2.

Referring initially to FIGS. 1-3, there are illustrated side elevation, top plan, and front elevation views, respectively, of a truck for collecting trash from a trash container in accordance with the present invention, generally designated as 20. FIG. 4 is an enlarged fragmented perspective view of area 4 of FIG. 2. Truck 20 includes a body which has a front 22. Truck 20 also includes a main hopper 24 which receives trash 500 from a trash container 502 (also refer to FIGS. 13 and 14). A trash-receiving station 26 is disposed in front of main hopper 24. As used herein the term "in front of" means closer to the front 22 of truck 20. Trash-receiving station 26 is disposed in fixed relationship with main hopper 24. That is, trash receiving station 26 does not move with respect to main hopper 24 as is the case with the intermediate trash collection container of U.S. Pat. No. 7,553,121. In effect, trash-receiving station 26 serves as an entry portal for main hopper 24. A main conveyor 28 moves trash 500 from trash-receiving station 26 to main hopper 24. Main conveyor 28 includes a moving belt which transports trash 500 from the lower trash-receiving station 26 to the higher entrance to main hopper 24. Main conveyor 28 also includes a plurality of spaced apart ribs 29 for engaging trash 500 and moving it upward. Trash-receiving station 26 includes a secondary moving belt conveyor 30 which moves trash 500 toward main conveyor 28.

A pick up arm assembly 32 is connected to front 22 of the body of truck 20. Pick up arm assembly 32 is similar to that disclosed in FIG. 2C of U.S. Pat. No. 7,553,121, and selectively picks up trash container 502 and dumps the trash 500 into trash-receiving station 26 (refer also to FIGS. 5-14). Pick up arm assembly 32 is known in the art and includes (1) a pair of grasping arms 34 which grasp trash container 502, (2) a sliding arm 36 which selectively extends and withdraws the grasping arms, and (3) a rotating arm 38 which selectively rotates to dump the contents of trash container 502. Because it is mounted on the front 22 of the body of truck 20, pick up arm assembly 32 can substantially extend across the entire front width W of truck 20. As such, pick up arm assembly 32 can have a longer sliding arm 36 which extends the reach of the device (refer also to FIG. 7). That is, because of the longer sliding arm 36, the present invention is able to pick up trash containers 500 which are further away from truck 20 such as across a lane of parked cars on a curb. This is in contrast to U.S. Pat. No. 7,553,121 in which the width of the sliding arm is limited to the width of the movable intermediate trash collection container which is substantially less than the width of the trash collection truck and does not allow pickups across a lane of parked cars to a curb.

Figure 15:
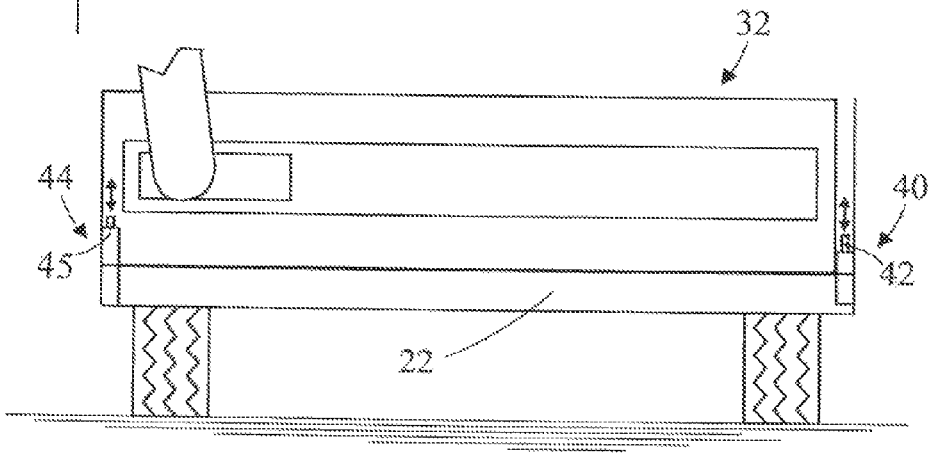
FIG. 15 is an enlarged view of area 15 of FIG. 3.
Figure 16:
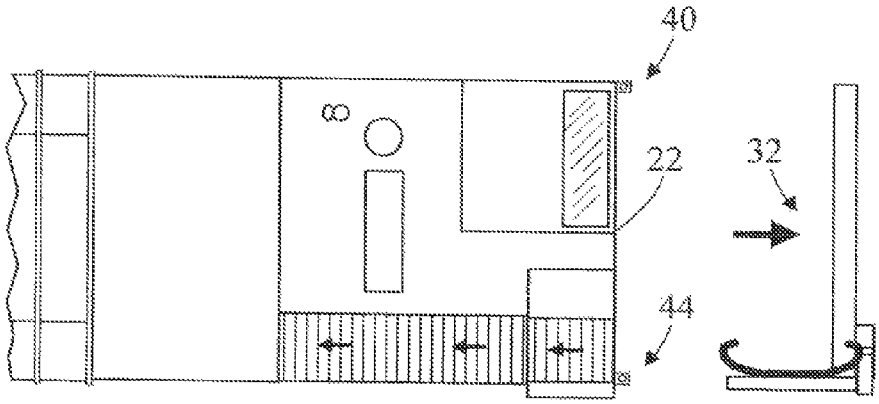
FIG. 16 is a top plan view of the pick up arm assembly removed from the front of the truck; and, FIG. 17 is a top plan view of the pick up arm assembly horizontally pivoted outward to a maintenance position.
Figure 17:
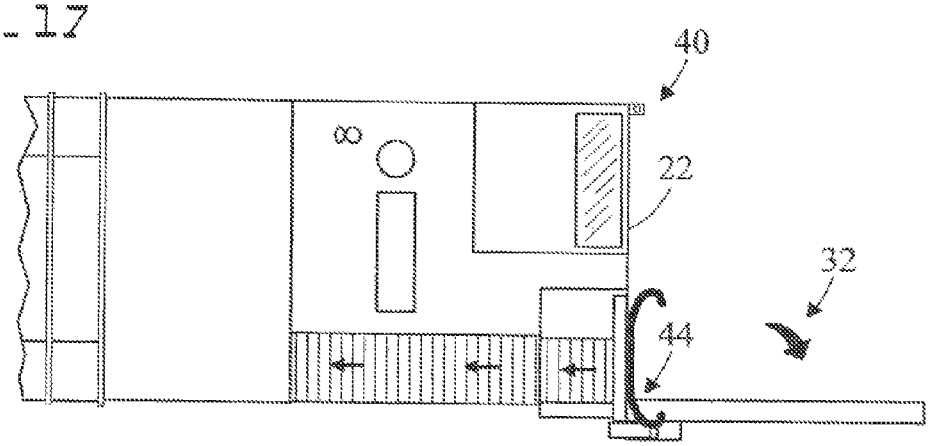

Pick up arm assembly 32 is pivotally connected to front 22, so that pick up arm assembly 32 can be horizontally pivoted outward for maintenance purposes (refer also to FIGS. 15-17 and the associated discussions). Truck 20 includes a half-cab 35 in which the operator sits that provides him with full visual access to the trash collection process which he can interrupt if something needs to be removed from the trash stream.

Figure 5:
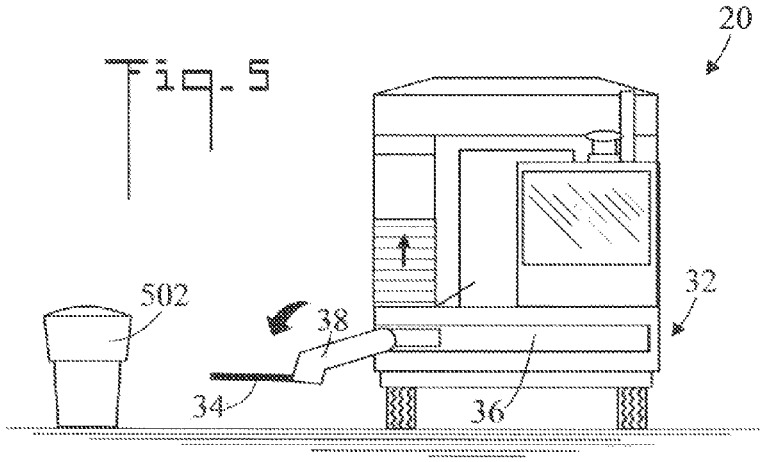
FIG. 5 is a front elevation view showing a pick up arm assembly in a lowered position.
Figure 6:
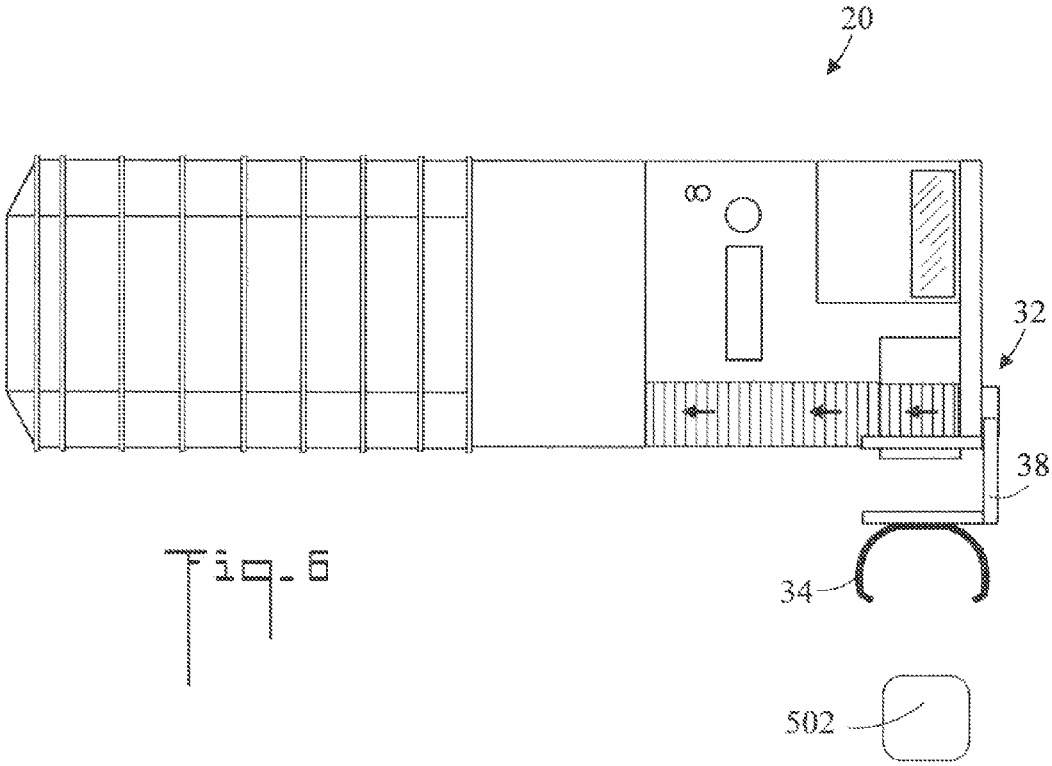
FIG. 6 is a top plan view FIG. 5.
Figure 7:
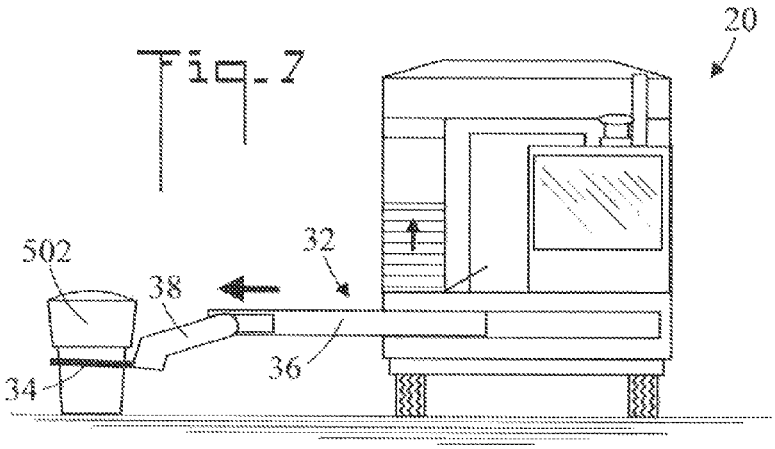
FIG. 7 is a front elevation view of the pick up arm assembly extended and grasping a trash container.
Figure 8:
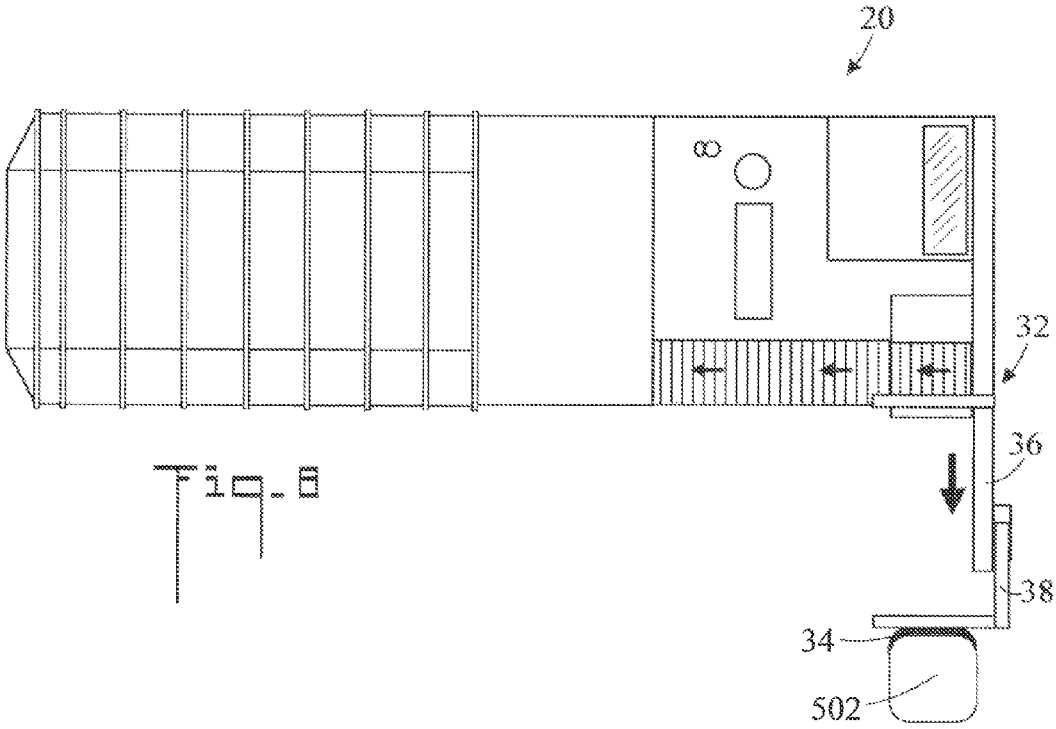
FIG. 8 is a top plan view of FIG. 7.
Figure 11:
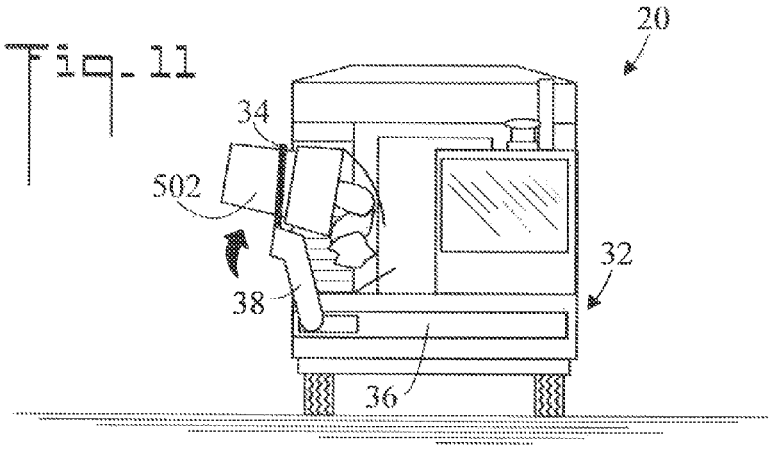
FIG. 11 is a front elevation view of the pick up arm assembly rotated and dumping the trash into a trash-receiving station.
Figure 12:
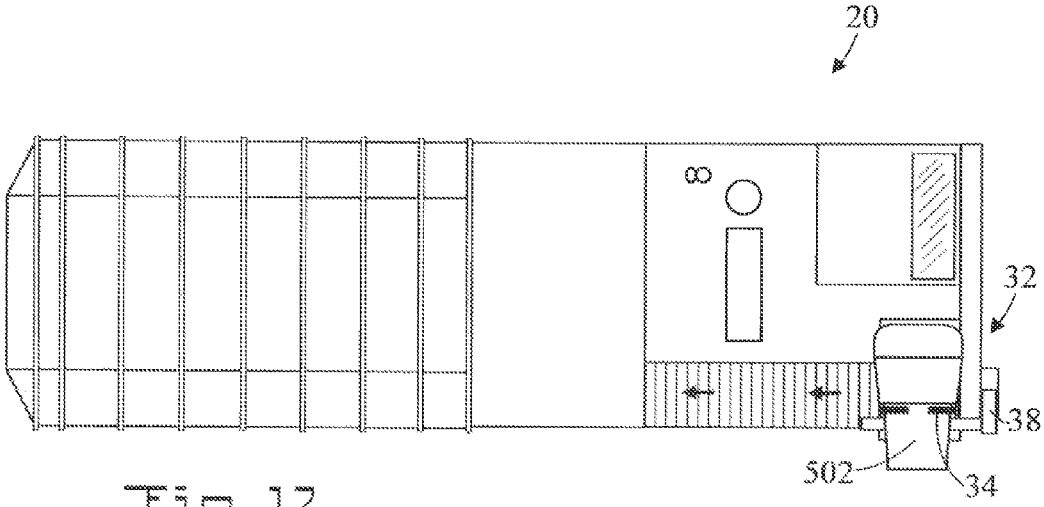
FIG. 12 is a top plan view of FIG. 11.

FIGS. 5-14 show the sequence of operations of the trash collection process. In FIGS. 5 and 6, pickup arm assembly 32 is placed in a lowered position wherein rotating arm 38 rotates as represented by the arrow from the storage position in FIG. 3 to place grasping arms 34 in position to engage trash container 502. In FIGS. 7 and 8, sliding arm 36 is extended as represented by the arrow and grasping arms 34 grasp trash container 502. In FIGS. 9 and 10, sliding arm 36 is retracted as represented by the arrow and trash container 502 is drawn toward truck 20. In FIGS. 11 and 12, rotating arm 38 rotates as represented by the arrow dumping the contents of trash container 502 into trash-receiving station 26. FIGS. 13 and 14 show main conveyor 28 moving the trash 500 from the trash-receiving station 26 to main hopper 24.

FIG. 15 is an enlarged view of area 15 of FIG. 3. Pick up arm assembly 32 is pivotally and removably connected to the front 22 of truck 20, so that the pick up arm assembly (1) can be easily removed and replaced (refer to FIG. 16), or (2) can be horizontally pivoted outward for maintenance purposes (refer to FIG. 17). The pivotal connection of pick up arm assembly 32 to front 22 is effected by pinned connectors. The pick up arm assembly has a first side and an opposite second side. Pinned connector 40 is on the first side and includes a pin 42 which when removed permits pick up arm assembly 32 to be separated from front 22 at the connection point. An opposite side pinned connector 44 having a pin 45 is on the second side and serves as a hinge. When pin 42 is removed from pinned connector 40, pick up arm assembly 32 can be horizontally pivoted (parallel to the support surface) outward about pinned connector 44 for maintenance purposes as is shown in FIG. 17. In this position the back side of pick up arm assembly 32 is accessible. Or pin 45 of pinned connector 44 can be pulled and the pick up arm assembly pivoted outward about pinned connector 42. When both pins 42 and 45 of pinned connectors 40 and 44 are pulled, pick up arm assembly 32 may be easily detached from front 22 for repair or replacement as shown in FIG. 16.

It is noted that in the figures the hydraulic lines and electrical cables which accompany pick up arm assembly 32 are not shown. These lines and cables restrict movement of the pick up arm assembly and have quick disconnects that are well known in the art. The quick disconnects are undone when the pick up arm assembly is pivoted for maintenance or removal.

FIG. 16 is a top plan view of pick up arm assembly 32 removed from front 22 of truck 20 by disengaging connectors 40 and 44.

FIG. 17 is a top plan view of pick up arm assembly 32 horizontally pivoted outward to a maintenance position. Pin 42 of pinned connector 40 has been pulled while pin 45 of pinned connector 44 is still in place so that pick up arm assembly 32 rotates about pinned connector 44.

In terms of use, a method for servicing a trash collection truck 20 includes:

(a) providing a truck 20 for collecting trash 500 from a trash container 502, including:

a body having a front 22;

a main hopper 24;

a trash-receiving station 26 disposed in front of main hopper 24;

a pick up arm assembly 32 connected to front 22, so that pick up arm assembly 32 can selectively pick up trash container 502 and dump its trash 500 into trash-receiving station 26; and, pick up arm assembly 32 pivotally connected to front 22, so that pick up arm assembly 32 can be horizontally pivoted outward for maintenance purposes;

(c) horizontally pivoting pick up arm assembly 32 outward; and, (c) performing maintenance activities on pick up arm assembly 32.

The preferred embodiments of the invention described herein are exemplary and numerous modifications, variations, and rearrangements can be readily envisioned to achieve an equivalent result, all of which are intended to be embraced within the scope of the appended claims.

I claim:

1. A truck for collecting trash from a trash container, comprising:

a body having a front;

a main hopper;

a trash-receiving station disposed in front of said main hopper, said trash-receiving station disposed in fixed relationship with said main hopper;

a pick up arm assembly connected to said front, so that said pick up arm assembly can selectively pick up the trash container and dump the trash into said trash-receiving station;

a main conveyor which moves trash from said trash-receiving station to said main hopper;

said trash-receiving station including a secondary conveyor which moves trash toward said main conveyor;

said pick up arm assembly pivotally connected to said front by two horizontal pivotal connections;

said pick up arm assembly horizontally pivotable outward for maintenance purposes;

said pick up arm assembly having a first side and an opposite second side;

a first horizontal pivotal connection disposed on said first side;

an opposite second horizontal pivotal connection disposed on said second side;

said first pivotal connection effected by a first pinned connector having a first pin, and said second pivotal connection effected by a second pinned connector having a second pin;

said pick up arm assembly horizontally pivotable by pulling said first pin and horizontally pivoting said pick up arm assembly about said second horizontal pivot connection; and, said pick up arm assembly removable from said front by pulling said first and second pins from said first pinned connector and said second pinned connector respectively.

2. A truck for collecting trash from a trash container, comprising:

a body having a front;

a main hopper;

a trash-receiving station disposed in front of said main hopper;

a pick up arm assembly connected to said front, so that said pick up arm assembly can selectively pick up the trash container and dump the trash into said trash-receiving station;

said pick up arm assembly including a sliding arm which selectively extends;

said pick up arm assembly substantially extending across the entire front width of said truck thereby increasing the reach of said sliding arm;

said pick up arm assembly pivotally connected to said front by two horizontal pivotal connections;

said pick up arm assembly horizontally pivotable outward for maintenance purposes;

said pick up arm assembly having a first side and an opposite second side;

a first horizontal pivotal connection disposed on said first side;

an opposite second horizontal pivotal connection disposed on said second side;

said first pivotal connection effected by a first pinned connector having a first pin, and said second pivotal connection effected by a second pinned connector having a second pin;

said pick up arm assembly horizontally pivotable by pulling said first pin and horizontally pivoting said pick up arm assembly about said second horizontal pivot connection; and, said pick up arm assembly removable from said front by pulling said first and second pins from said first pinned connector and said second pinned connector respectively.

* * * * *